US008936480B2

(12) United States Patent
Hsieh

(10) Patent No.: US 8,936,480 B2
(45) Date of Patent: Jan. 20, 2015

(54) ELECTRICAL CONNECTOR FOR FPC

(71) Applicant: Hon Hai Precision Industry Co., Ltd., New Taipei (TW)

(72) Inventor: Wen-Yi Hsieh, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 28 days.

(21) Appl. No.: 13/798,161

(22) Filed: Mar. 13, 2013

(65) Prior Publication Data

US 2013/0244464 A1 Sep. 19, 2013

(30) Foreign Application Priority Data

Mar. 13, 2012 (TW) ..... 101204450

(51) Int. Cl.
*H01R 12/77* (2011.01)
*H01R 12/79* (2011.01)
*H01R 13/629* (2006.01)

(52) U.S. Cl.
CPC ..... *H01R 12/77* (2013.01); *H01R 12/79* (2013.01); *H01R 13/62994* (2013.01)
USPC ..... 439/261

(58) Field of Classification Search
USPC ..... 439/260, 261, 267, 495
See application file for complete search history.

(56) References Cited

U.S. PATENT DOCUMENTS

| | | | | |
|---|---|---|---|---|
| 7,052,300 | B2 * | 5/2006 | Okita et al. | 439/260 |
| 7,530,831 | B2 * | 5/2009 | Nishimatsu et al. | 439/260 |
| 7,713,078 | B2 * | 5/2010 | Nishimatsu et al. | 439/260 |
| 7,828,570 | B2 * | 11/2010 | Suzuki et al. | 439/260 |
| 8,323,044 | B2 * | 12/2012 | Tsunemura | 439/267 |
| 8,641,439 | B2 * | 2/2014 | Tateishi et al. | 439/260 |
| 2006/0189190 | A1 * | 8/2006 | Kato | 439/261 |
| 2013/0244464 | A1 * | 9/2013 | Hsieh | 439/261 |

FOREIGN PATENT DOCUMENTS

| | | |
|---|---|---|
| CN | 201498687 | 6/2010 |
| TW | M400686 | 3/2011 |

* cited by examiner

*Primary Examiner* — Alexander Gilman
(74) *Attorney, Agent, or Firm* — Wei Te Chung; Ming Chieh Chang

(57) ABSTRACT

An electrical connector includes an insulative housing, a plurality of contacts and an actuator. The insulative housing defines a front opening and a back receiving space. The receiving space defines a horizontal plane and a vertical plane connecting each other. The contacts include retaining portions, contacting portions and pressing portions. Each contacting portion and corresponding pressing portion extends oppositely from the retained portion. The actuator includes a base portion and several separate costal parts extending from the base portion. Adjacent costal parts are connected by a shaft and the pressing portions are against to the shaft. The actuator rotates around the shaft and defines a cambered surface at the costal parts, the cambered surface slides between the horizontal plane and the vertical plane.

8 Claims, 6 Drawing Sheets

ELECTRICAL CONNECTOR FOR FPC

BACKGROUND OF THE INVENTION

1. Field of the Invention

The present invention relates to an electrical connector, and more particularly to an electrical connector for a flexible printed circuit, a flexible flat circuit or the like, collectively named as FPC.

2. Description of Related Art

Taiwan Utility No. M400686 discloses an electrical connector for an FPC. The electrical connector comprises an insulative housing, several contacts shaped as "H" and an actuator. The actuator is assembled at a back of the insulative housing and presses at the contacts. The actuator has a pair of axis retained in responding ring holes set at the insulative housing. The actuator is raised up so as to push the back end of the contacts up. So the front end (as a contacting portion connected to the FPC) is raised up due to cantilever principle. Nevertheless, the reciprocating action may lead the axis to be destroyed.

Hence, an electrical connector with better mechanical property for reciprocating action is needed.

BRIEF SUMMARY OF THE INVENTION

The present invention provides an electrical connector comprising an insulative housing, a plurality of contacts and an actuator. The insulative housing defines a front opening and a back receiving space. The receiving space defines a horizontal plane and a vertical plane connecting each other. The contacts include retaining portions, contacting portions and pressing portions. Each contacting portion and corresponding pressing portion extend oppositely from the retained portion. The actuator includes a base portion and several separated costal parts extending from the base portion. Adjacent costal parts are connected by a shaft and the pressing portions are assembled with the shaft. The actuator rotates around the shaft and defines a cambered surface at the costal parts, the cambered surface slides between the horizontal plane and the vertical plane.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
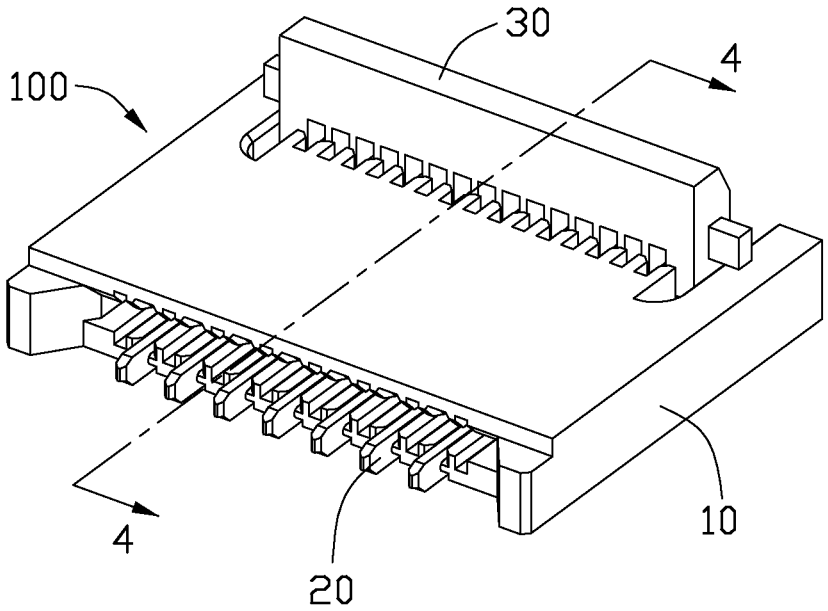
FIG. 1 is a perspective view of an electrical connector in accordance with an embodiment of the present invention.

Reference will now be made to the drawing figures to describe the preferred embodiment of the present invention in detail. FIGS. 1 to 5 illustrate an electrical connector 100 for an FPC 200. The electrical connector 100 comprises an insulative housing 10, several contacts 20 retained on the insulative housing and an actuator 30 located at a back end of the insulative housing.

Figure 2:
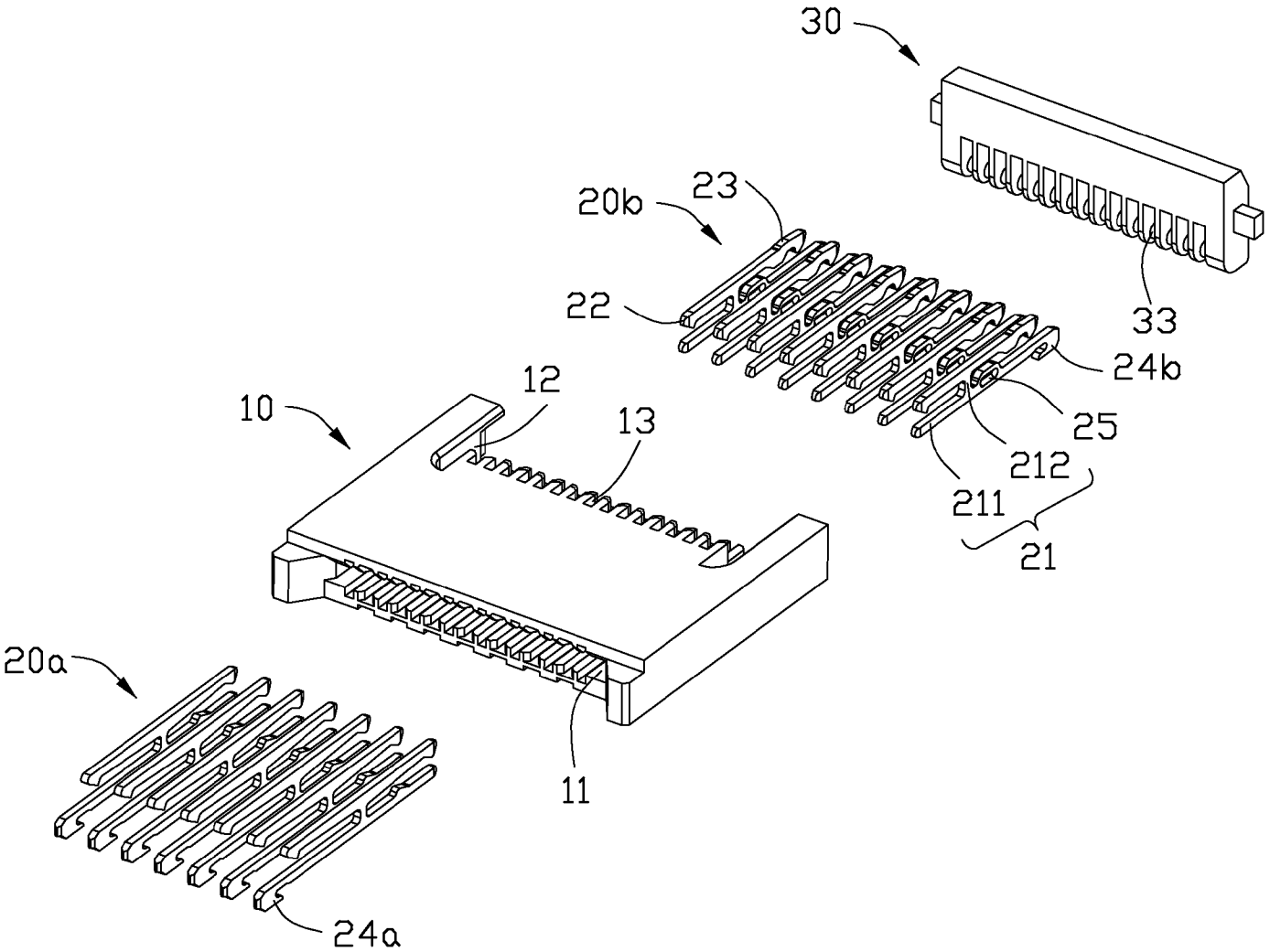
FIG. 2 is an exploded view of the electrical connector.

Referring to FIG. 2, the insulative housing 10 is shaped as a rectangular form, which comprises a front opening 11 through a front end thereof and a rear receiving space 12 at the back end thereof.

The contacts 20 are received in several passageways 13 defined on a bottom wall of the housing. The contact includes a retaining portion 21, a contacting portion 22 extending from a front of the retaining portion and a pressing portion 23 extending from a back of the retaining portion. The retaining portion 21 has a horizontal portion 211 and a vertical portion 212 extending from the center of the horizontal portion. The vertical portion 212 joints the horizontal portion, the contacting portion 22 and the pressing portion 23 together. The contacting portion 22 and the pressing portion 23 both extend from opposite sides of a top tip of the vertical portion 212. The contacts 20 are divided to two groups 20*a* and 20*b* by assembling directions thereof. The first contact 20*a* comprises a hamulate soldering portion 24*a* extending from the front end of the horizontal portion 211 while the second contact 20*b* comprises a hamulate soldering portion 24*b* extending from the back end of the horizontal portion 211.

Figure 3:
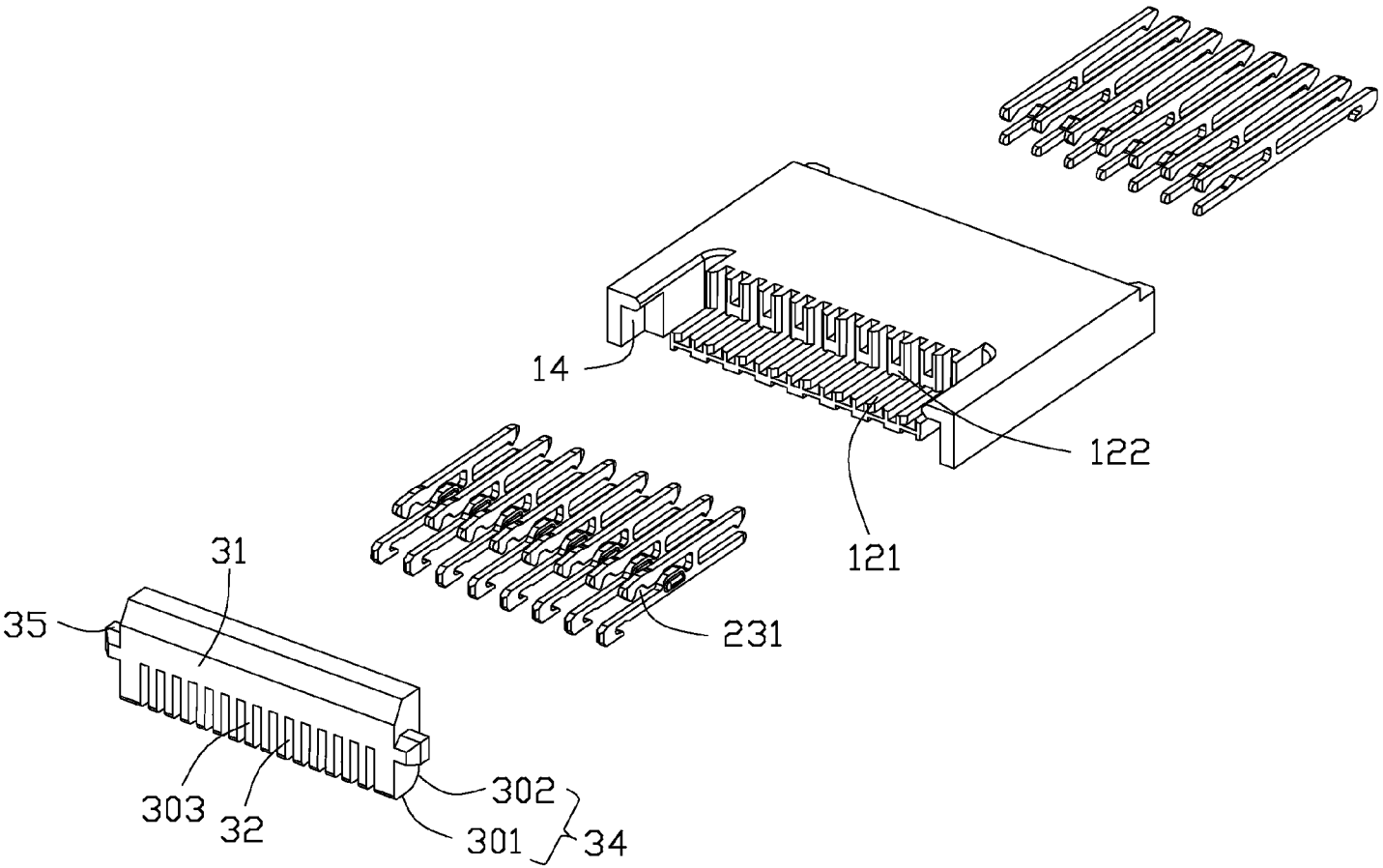
FIG. 3 is another exploded view of the electrical connector from another point of view.
Figure 4:
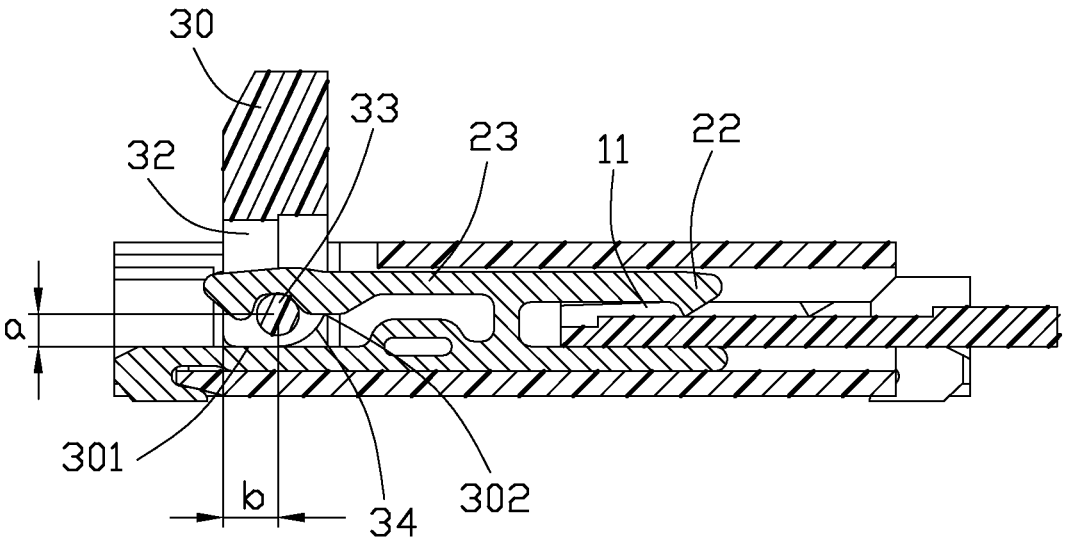
FIG. 4 is a cross sectional view of the electrical connector in a open condition taken along lines 4-4 in FIG. 1.

Referring to FIGS. 3 and 4, the contacting portions 22 are exposed to the opening 11 to electrically connect to the FPC. The pressing portions 23 are located in the receiving space 12. The receiving space 12 defines a horizontal plane 121 and a vertical plane 122 labeled in FIG. 3, which two intersect with each other perpendicularly. The actuator 30 could rotate between the horizontal plane 121 and the vertical plane 122. The actuator 30 comprises a base portion 31 and a comb portion with several costal parts 32 separated from each other extending from the base portion. Adjacent costal parts are connected by a cylinder shaft 33 with a slot therearound. The pressing portions 23 of the contacts 20 go through the slots and press against the cylinder shaft 33 (shown in FIG. 2). The actuator 30 also has a pair of ear portions 35 protruding from both sides of the base portion. The ear portions are fixed in a pair of recesses 14 for assembling the actuator 30 at the receiving space 12. The actuator 30 rotates around the shaft relative to the housing.

Figure 5:
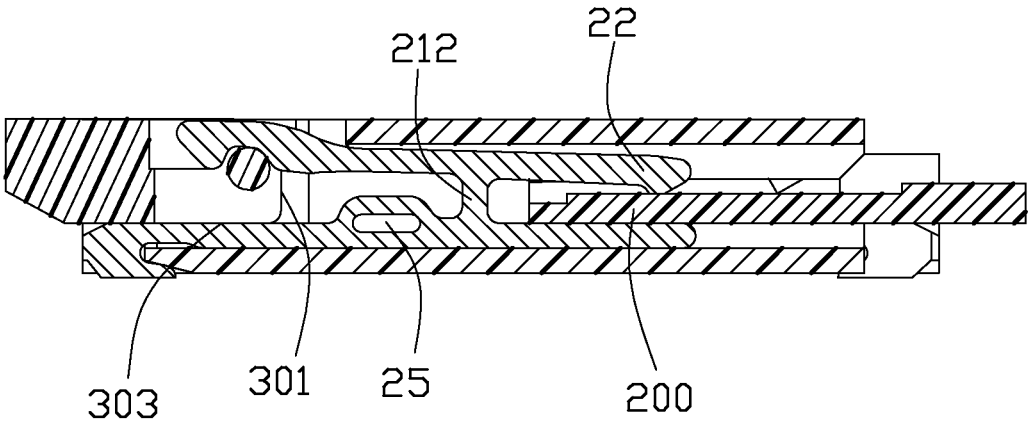
FIG. 5 is a cross sectional view similar to FIG. 4, wherein the electrical connector in a closed condition.

Referring to FIG. 4, when the actuator 30 is received in the receiving space 12, a recessed-hook 231 is formed at the free end of the pressing portion 23 for receiving the cylinder shaft 33 reelingly. When the actuator 30 stands vertically as best shown in FIG. 4, the costal parts 32 define a bottom surface 301 and a front surface 302 toward the opening 11. The bottom surface 301 and the front surface 302 are in a continuous connection and form a cambered surface 34 at a jointing corner thereof. The cambered surface 34 is tangent to both the horizontal plane 121 and the vertical plane 122. When the actuator is rotated, the cambered surface 34 rotates around the cylinder shaft 33 and the cylinder shaft turns around in the recessed-hook. After the actuator rotates at a horizontal location as shown in FIG. 5, a back surface 303 opposite to the front surface 302 is pressed against the horizontal plane 121, the bottom surface 301 faces to the vertical plane 122 and is separated from the vertical plane 122. The cylinder shaft 33 defines a center line. The distance between the center line and the bottom surface 301 defined as "a" is equal to a distance between the center line and the front surface 302, but is less than a distance between the center line and the back surface 303 defined as "b". A pre-set distance is provided to separate the cylinder shaft 33 from a bottom of the receiving space 12, resulting in the pressing portions 23 being raised up and actuating the contacting portions 22 to press against the FPC. The pre-set distance is equal to the difference between "a" and "b".

When the actuator 30 is at the horizontal location to retain the FPC, the cylinder shaft 33 and the pressing portions 23 will be lifted. The contacting portions 22 will be pressed downward due to lever principle. The pressing portions 23 help to lock the FPC 200 stably. Actually, the rotation of the actuator 30 is achieved by the cambered surface 34 sliding between the horizontal plane 121 and the vertical plane 122, which leads to a simpler structure. The cambered surface 34 is pre-burnished to decrease the friction. Compared with ordinary shaft (usually shaped as ellipse) of a connector for an FPC, the shaft is shaped as cylinder with less friction.

Figure 6:
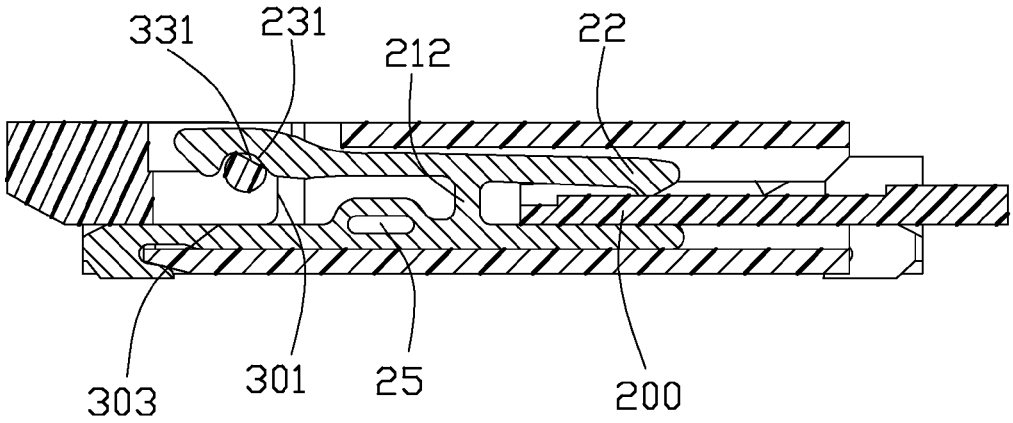
FIG. 6 is a cross sectional view of an electrical connector with another embodiment.

FIG. 6 shows another embodiment of the present invention, the cylinder shaft 33 has a cutout 331. When the actuator is at a horizontal location, the cutout presses against the recessed-hook 231 of the pressing portion 23. Compared with a cylinder shaft with no cutout, the height of the pressing portion being raised will be properly decreased.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector, comprising:

an insulative housing defining a front opening and a back receiving space, the receiving space defining a horizontal plane and a vertical plane connecting with each other;

a plurality of contacts comprising retaining portions, contacting portions and pressing portions, each contacting portion and corresponding pressing portion extending oppositely from the retained portion;

an actuator comprising a base portion and several separated costal parts extending from the base portion, adjacent costal parts being connected by a shaft and the pressing portions being assembled with the shaft;

wherein the actuator rotates around the shaft and defines a cambered surface at the costal parts, the cambered surface slides between the horizontal plane and the vertical plane;

wherein each costal part further defines a horizontal bottom surface and a front surface perpendicular to each other and smoothly connecting opposite ends of the cambered surface, when the actuator is at a vertical location, the front surface touches the vertical plane and the bottom surface touches the horizontal plane, the front surface and the bottom surface form the cambered surface.

2. The electrical connector as claimed in claim 1, wherein when the actuator is at a horizontal location, the costal parts define a back surface touching the horizontal surface, the pressing portions are raised and leading the contacting portions to be raised.

3. The electrical connector as claimed in claim 2, wherein a distance between a center of shaft and the bottom surface is less than a distance between the center of shaft and the back surface.

4. An electrical connector comprising:

an insulative housing defining a receiving space;

a plurality of contacts disposed in the housing, each of said contacts defining a pressing portion facing the receiving space;

an actuator disposed in the receiving space and defining a plurality of shaft sections to respectively abut against the corresponding pressing portions, sad actuator further defining opposite upper and lower horizontal surfaces linked by a vertical surface when said actuator is viewed in a horizontal closed position; wherein a cambered surface is formed between a corner around the upper horizontal surface and the vertical surface so as to have the upper horizontal surface abut against a corresponding vertical plane formed on the housing in a front-to-back direction when said actuator is moved from the closed position to a vertical open position; wherein said cambered surface defines a length fully corresponding to rotation of the actuator from the horizontal closed position to the vertical open position.

5. The electrical connector as claimed in claim 4, wherein said vertical surface is spaced from the vertical plane when said actuator is located in the horizontal closed position.

6. The electrical connector as claimed in claim 5, wherein another corner around the lower horizontal surface and the vertical surface defines a less cambered surface.

7. The electrical connector as claimed in claim 4, wherein the cambered surface connects to the upper horizontal surface in a tangential manner.

8. The electrical connector as claimed in claim 4, wherein the cambered surface connects to the vertical surface in a tangential manner.

* * * * *